US011858029B2

(12) United States Patent
Sekitomi et al.

(10) Patent No.: US 11,858,029 B2
(45) Date of Patent: Jan. 2, 2024

(54) METHOD FOR PROCESSING ROUND METALLIC WIRE, ROUND METALLIC WIRE PROCESSING APPARATUS AND METHOD FOR MANUFACTURING POWER DISTRIBUTION COMPONENT

(71) Applicant: MATSUO INDUSTRIES, INC., Nagoya (JP)

(72) Inventors: Yuji Sekitomi, Obu (JP); Kunihito Takeuchi, Obu (JP); Mamoru Toda, Obu (JP)

(73) Assignee: MATSUO INDUSTRIES, INC., Nagoya (JP)

( * ) Notice: Subject to any disclaimer, the term of this patent is extended or adjusted under 35 U.S.C. 154(b) by 0 days.

(21) Appl. No.: 17/761,749

(22) PCT Filed: Sep. 24, 2020

(86) PCT No.: PCT/JP2020/036121

§ 371 (c)(1),
(2) Date: Mar. 18, 2022

(87) PCT Pub. No.: WO2021/079681

PCT Pub. Date: Apr. 29, 2021

(65) Prior Publication Data

US 2022/0371075 A1 Nov. 24, 2022

(30) Foreign Application Priority Data

Oct. 25, 2019 (JP) ..... 2019-193979

(51) Int. Cl.
*B21F 1/02* (2006.01)
*B21F 1/00* (2006.01)

(52) U.S. Cl.
CPC ..... *B21F 1/004* (2013.01)

(58) Field of Classification Search
CPC .. B21F 1/00; B21F 1/004; B21F 1/006; B21F 1/008; B21F 1/02; B21F 1/06; B21F 5/00; B21F 1/026; H01B 7/181; B21D 7/03

(Continued)

(56) References Cited

U.S. PATENT DOCUMENTS 1,709,938 A * 4/1929 Goldberg ..... B21G 1/003 140/87
1,936,611 A * 11/1933 Young ..... B21F 45/00 72/401

(Continued)

FOREIGN PATENT DOCUMENTS

FR 2744045 A3 8/1997
JP S62137132 A 6/1987

(Continued)

OTHER PUBLICATIONS

JP 2007-265657A, Hirano Oct. 2007.*

(Continued)

*Primary Examiner* — Edward T Tolan
(74) *Attorney, Agent, or Firm* — Maier & Maier, PLLC

(57) ABSTRACT

A three-dimensionally shaped round metallic wire having a cross-section non-circular portion in a predetermined portion without performing additional processing and having specified dimensional accuracy and accuracy of form. In an intermediate step in which the round metallic wire is processed in a predetermined three-dimensional shape, a cross-section non-circular portion forming machine 20 which forms the cross-section non-circular portion having a non-circular cross-sectional shape in at least one position is included. At the time of bending, the cross-section non-circular portion is held by a wire holding portion of a bending machine 30, and the bending is performed in the predetermined three-dimensional shape. Holding the cross- (Continued)

section non-circular portion causes relative rotation between the cross-section non-circular portion and the wire holding portion to be suppressed as compared with a case of the cross-section circular shape. Accordingly, bending accuracy in the three-dimensional shape for the round metallic wire is improved.

4 Claims, 9 Drawing Sheets

(58) Field of Classification Search
USPC ..... 72/31.04; 140/80, 81, 82, 123
See application file for complete search history.

(56) References Cited

U.S. PATENT DOCUMENTS 2,838,075 A * 6/1958 Terry ..... B21F 1/00 140/71.6
4,654,912 A * 4/1987 Gray ..... B21D 11/10 72/213
5,203,191 A * 4/1993 Maggi ..... B21F 99/00 72/454
7,571,631 B2 * 8/2009 Moskowitz ..... B21F 1/004 269/291

FOREIGN PATENT DOCUMENTS

| | | | |
|---|---|---|---|
| JP | 2014-128095 | A | 7/2014 |
| JP | 2014-161872 | A | 9/2014 |
| JP | 2016-221551 | A | 12/2016 |
| JP | 2017-55486 | A | 3/2017 |
| KR | 101748862 | B1 | 6/2017 |

OTHER PUBLICATIONS

International Search Report dated Dec. 15, 2020 in corresponding International application No. PCT/JP2020/036121; 5 pages.
Written Opinion of the International Searching Authority dated Dec. 15, 2020 in corresponding International application No. PPCT/JP2020/036121; 6 pages.
Extended Search Report dated Dec. 9, 2022, in corresponding European Application No. 20879857.9, 12 pages.

* cited by examiner

METHOD FOR PROCESSING ROUND METALLIC WIRE, ROUND METALLIC WIRE PROCESSING APPARATUS AND METHOD FOR MANUFACTURING POWER DISTRIBUTION COMPONENT

TECHNICAL FIELD

The present invention relates to a processing method and a processing apparatus for a round metallic wire provided as a conductor in a predetermined position of an electric device, and a method for manufacturing a power distribution component formed by integrating a resin member with the round metallic wire.

BACKGROUND

A round metallic wire formed of a solid wire in a cross-section circular shape is used as conductors of various electric devices. The round metallic wire is inexpensive as compared with a square wire in a cross-section square shape, and excellent in strength against tension and bending, and further has such an advantage as easier bending in a desired direction than the square shape when attached to the electric device. In focusing attention on such an advantage, for example, in Japanese Patent Application Laid-open No. 2014-128095, the round metallic wire is used as a power line for supplying electric power to a three-phase rotary electric machine such as a motor. On the other hand, connecting three power lines to terminals individually brings about a problem such that flexibility of the power line causes a displacement at the time of fastening to the terminal, and Japanese Patent Application Laid-open No. 2014-128095 proposes that to prevent such a displacement, a power-line fixing member including three insertion holes through which the three power lines are inserted is used. By using such a power-line fixing member, the displacement is securely suppressed, but due to the circular cross section of the power line, it rotates centered at an axial center in the insertion hole of the power-line fixing member. As a result, difficulty of positioning at the time of fastening with the terminal and a displacement due to vibrations have been unable to be completely eliminated. In consideration of this point, Japanese Patent Application Laid-open No. 2017-55486 discloses a technique in which a jig crushes a predetermined portion of a power line to a cross-section non-circular shape and a resin member which is a power-line fixing member is molded integrally with this portion. Since the resin member is integrated with the cross-section non-circular portion, relative rotation between the power line and the resin member is suppressed.

SUMMARY

However, Japanese Patent Application Laid-open No. 2017-55486, the cross-section non-circular portion is formed on the power line by the jig before the resin member as the power-line fixing member is integrated therewith. The round metallic wire made of copper or the like has flexibility, and hence can be bent to some extent to be fitted to a shape of an attachment portion when assembled to the motor or the like as described above, but actually, a power line formed in a three-dimensional shape, whose bending angle, length, and the like are specified beforehand to be fitted to the attachment portion, is used. The power line in Japanese Patent Application Laid-open No. 2017-55486 is also similar, and the predetermined portion of the three-dimensionally shaped power line processed to given design specifications is crushed by the jig through additional processing, and the resin member is integrated therewith.

Subjecting such a round metallic wire processed to/with the given design specifications and accuracy to the processing of partial crushing with the jig affects the bending angle, a bend position, and the like of the round metallic wire formed in the three-dimensional shape, and even though an aim to stop the rotation by using the resin member can be attained, there is a possibility that dimensional accuracy and accuracy of form of the round metallic wire itself are inferior against the design specifications.

The present invention was made in consideration of the above and has an object to provide a method for processing a round metallic wire and a round metallic wire processing apparatus which make it possible to process a three-dimensionally shaped round metallic wire having a cross-section non-circular portion in a predetermined portion without performing additional processing, and having specified dimensional accuracy and accuracy of form, and a method for manufacturing a power distribution component.

Means for Solving the Problems

To solve the above problems, a method for processing a round metallic wire of the present invention, the method for processing the round metallic wire formed of a cross-section circular solid wire, and subjected to bending in a predetermined three-dimensional shape and provided as a conductor in a predetermined position of an electric device, the method includes:

a correction step of linearly correcting a coiled material of the round metallic wire;

a cross-section non-circular portion forming step of forming a cross-section non-circular portion having a non-circular cross-sectional shape in a diameter direction in at least one position of the round metallic wire linearly corrected by the correction step; and a bending step of holding the cross-section non-circular portion in a wire holding portion of a bending machine and performing bending in the three-dimensional shape.

Preferably, in the cross-section non-circular portion forming step, the cross-section non-circular portion is processed in a shape including a flat surface which comes into surface contact with an abutting surface of the wire holding portion of the bending machine.

Preferably, at either timing after the correction step and before the cross-section non-circular portion forming step or timing after the cross-section non-circular portion forming step, the round metallic wire is cut in a predetermined length.

Further, a round metallic wire processing apparatus of the present invention for subjecting a cross-section circular solid wire provided as a conductor in a predetermined position of an electric device to bending in a predetermined three-dimensional shape, the apparatus includes:

a straightening machine which linearly corrects a coiled material of the round metallic wire;

a cross-section non-circular portion forming machine which forms a cross-section non-circular portion having a non-circular cross-sectional shape in a diameter direction in at least one position of the round metallic wire linearly corrected by the straightening machine;

a bending machine which holds the cross-section non-circular portion in a wire holding portion and performs bending in the three-dimensional shape; and a cutting machine which cuts the round metallic wire.

Preferably, the cross-section non-circular portion forming machine includes a pressing portion which forms a flat surface which makes the cross-section non-circular portion in surface contact with an abutting surface of the wire holding portion of the bending machine.

Further, a cutting machine control unit which at either timing after the correction and before the formation of the cross-section non-circular portion or timing after the formation of the cross-section non-circular portion and before the bending, controls the cutting machine to cut the round metallic wire in a predetermined length is included.

Further, a method for manufacturing a power distribution component of the present invention, the method for manufacturing the power distribution component including a processed product of a round metallic wire formed of a cross-section circular solid wire and subjected to bending in a predetermined three-dimensional shape and a resin member attached integrally with the processed product, and provided in a predetermined position of an electric device, On an outer periphery of the cross-section non-circular portion of the processed product of the round metallic wire processed by the method for processing the round metallic wire, the resin member is fixed.

Effect of the Invention

According to the present invention, in an intermediate step in which the round metallic wire is processed in the predetermined three-dimensional shape, in at least one position, the cross-section non-circular portion having a non-circular cross-sectional shape is formed. At the time of bending, this cross-section non-circular portion is held by the wire holding portion of the bending machine, and the bending is performed in the predetermined three-dimensional shape. Holding the cross-section non-circular portion causes relative rotation centered at an axial center between the cross-section non-circular portion and the wire holding portion to be suppressed as compared with a case of the cross-section circular shape. In particular, processing this cross-section non-circular portion in a shape including the flat surface which comes into surface contact with the abutting surface of the wire holding portion of the bending machine causes the relative rotation between the cross-section non-circular portion and the wire holding portion to be further suppressed. As a result, bending accuracy in the three-dimensional shape is improved. Further, a displacement is eliminated in a holding position of the wire holding portion of the bending machine, which also reduces an error among processed products. Further, normally, after the bending, dimensional measurement is performed on the processed products by using an optical microscope or the like. At this time, the cross-section circular shape makes it difficult to focus on a tangent along a longitudinal direction, and makes positioning relative to a reference line of the optical microscope difficult, but having the cross-section non-circular portion, preferably having the flat surface makes a visible line clear, which makes it easy to focus on it and makes the positioning easy, resulting in improvement also in dimensional measurement accuracy.

Hence, according to the present invention, after obtaining the processed product of the three-dimensionally shaped round metallic wire having high dimensional accuracy and accuracy of form, the round metallic wire can be combined with the member such as a rotation stopper as it is while maintaining the high dimensional accuracy and the like without a need to perform additional processing for forming the cross-section non-circular portion. Further, the power distribution component integrated with the resin member by insert molding can also be manufactured easily by using the cross-section non-circular portion as it is without performing the additional processing.

DETAILED DESCRIPTION OF THE EMBODIMENTS

Figure 1A:
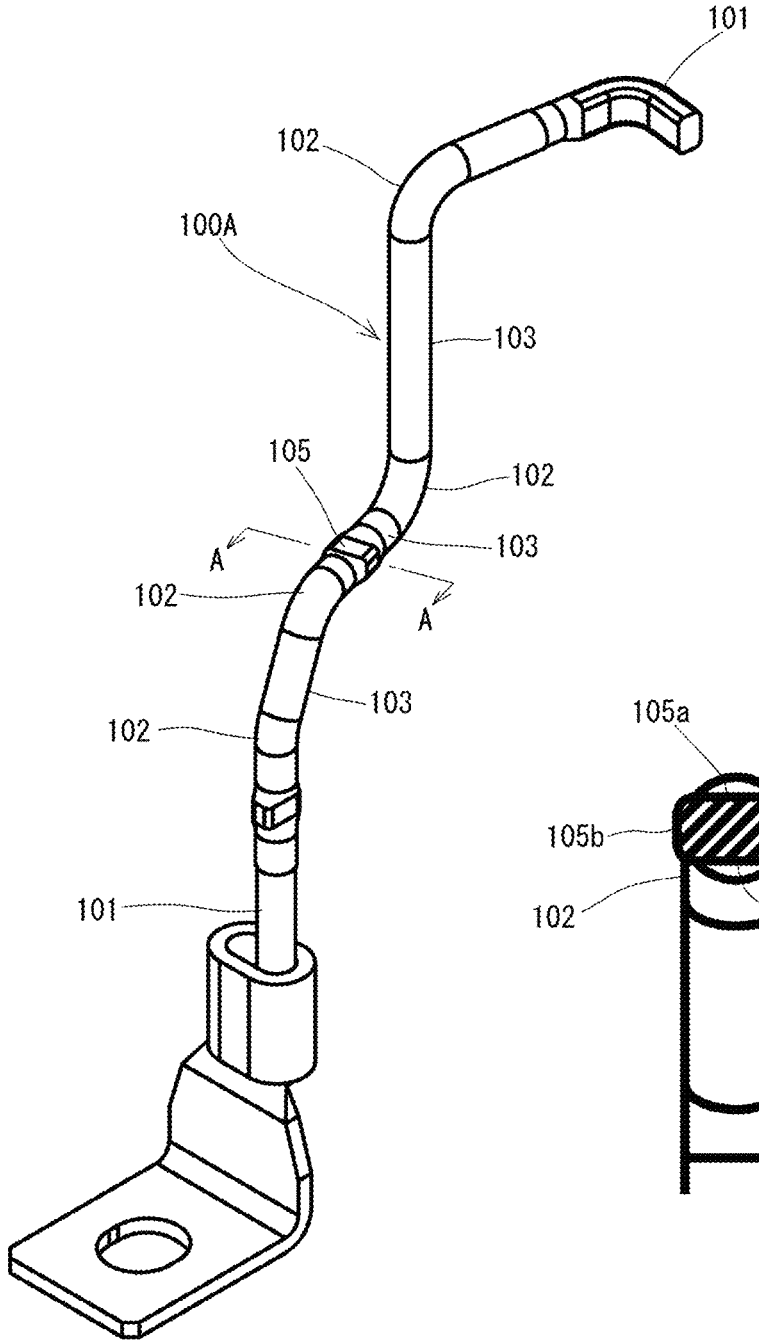
FIG. 1(*a*) is a perspective view illustrating one example of a wire processed product (finished processed product) of a round metallic wire processed using a round metallic wire processing apparatus according to one embodiment of the present invention, FIG. 1(*b*) is an enlarged sectional view taken along an A-A line of FIG. 1(*a*).
Figure 1B:
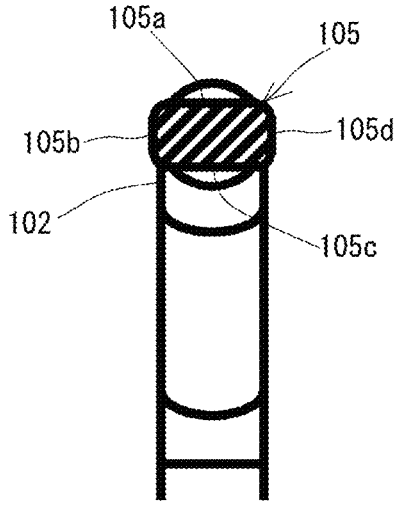

An embodiment of the present invention will be hereinafter described using the drawings. FIG. 1(*a*) illustrates a processed product (hereinafter, to be referred to as "wire processed product") 100A of a round metallic wire 100 processed using a round metallic wire processing apparatus 1 (refer to FIG. 3) according to one embodiment of the present invention. The wire processed product 100A is used as, for example, a power line of a motor or the like as indicated in Japanese Patent Application Laid-open No. 2014-128095 and Japanese Patent Application Laid-open No. 2017-55486, and formed in a three-dimensional shape to include connecting portions 101, 101 to be connected to terminals or the like at both end portions, a plurality of bent portions 102, 102, and straight portions 103, 103 between them. Then, in any portion of the wire processed product 100A, in this embodiment, in a range of the straight portion 103 in the vicinity of the middle of the entire length, a cross-section non-circular portion 105 having a non-circular cross-sectional shape in a diameter direction (a direction orthogonal to a longitudinal direction (axial center direction) of the round metallic wire 100) of the round metallic wire 100 is formed. A shape of the cross-section non-circular portion 105 is formed in a rectangle having four flat surfaces 105*a* to 105*d* on an outer peripheral surface as illustrated in FIG. 1(*b*) in this embodiment. Note that this shape of the cross-section non-circular portion 105 will be further described later.

Figure 2A:
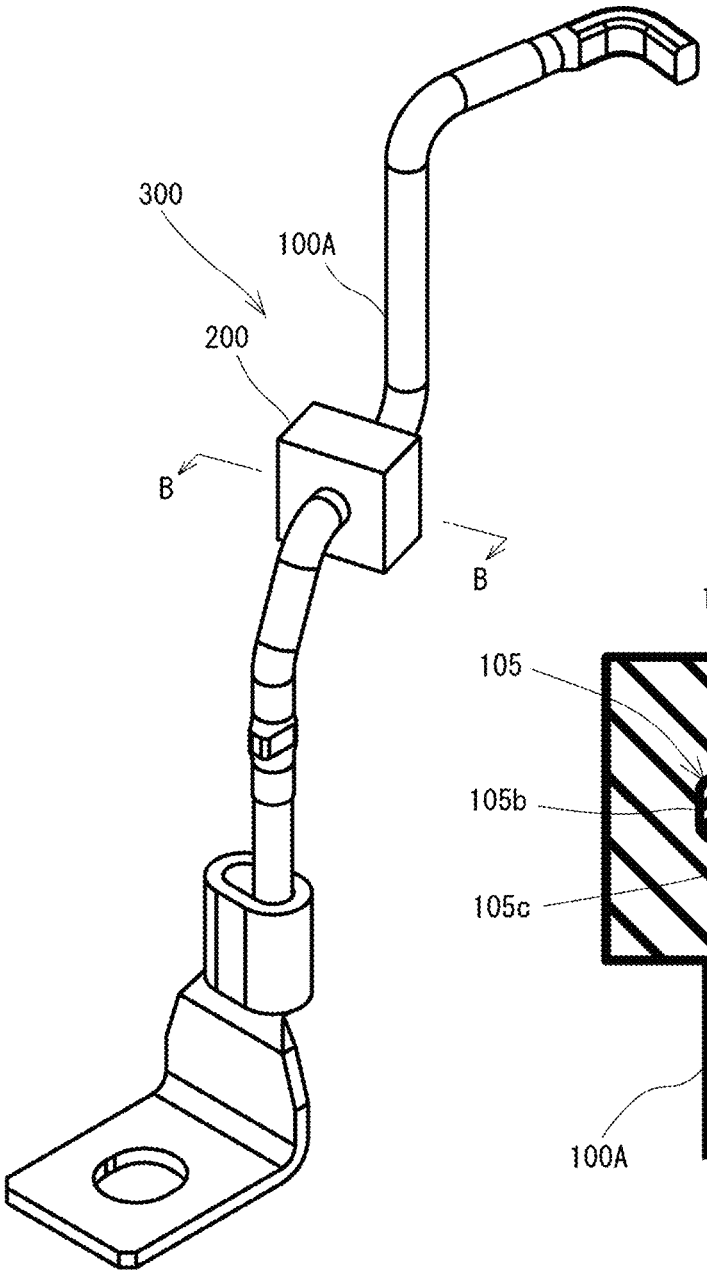
FIG. 2(*a*) is a perspective view illustrating one example of a power distribution component in which a resin member for rotation stopper is attached by being molded integrally with the wire processed product illustrated in FIG. 1, FIG. 2(*b*) is an enlarged sectional view taken along a B-B line of FIG. 2(*a*).
Figure 2B:
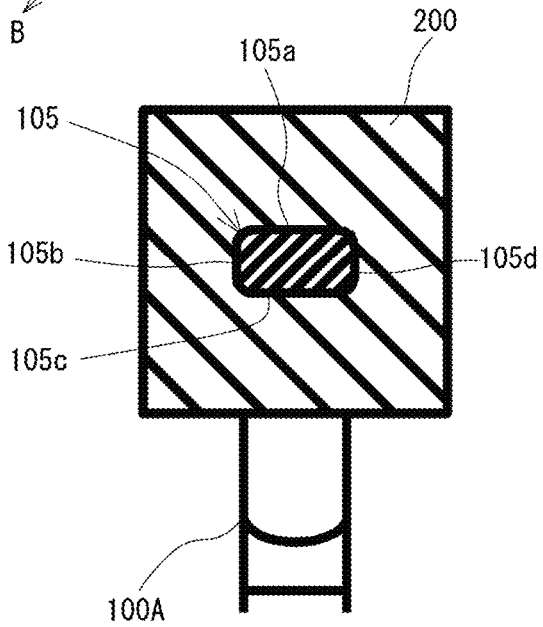

The wire processed product 100A is set in a metal mold, and a resin member 200 is integrated by insert molding (refer to FIG. 2(*a*)). At this time, as illustrated in FIG. 2(*b*), the resin member 200 is integrated closely around the cross-section non-circular portion 105. The cross-section non-circular portion 105 has the four flat surfaces 105*a* to 105*d*, which eliminates the occurrence of relative rotation between them and the resin member 200 closely covering their peripheries. As a result, the wire processed product 100A of the round metallic wire 100 gets rid of being rotated and displaced in an axial direction at the time of fastening with the terminal of the motor or the like or by action of external vibrations, or the like. Note that as indicated in Japanese Patent Application Laid-open No. 2014-128095 and Japanese Patent Application Laid-open No. 2017-55486, for example, in a case of being used for a three-phase motor or the like, it is naturally possible to have a structure in which the three wire processed products 100A of the round metallic wires 100 are subjected to insert molding together and covered with the common resin member 200 to thereby prevent a mutual displacement.

Figure 3:
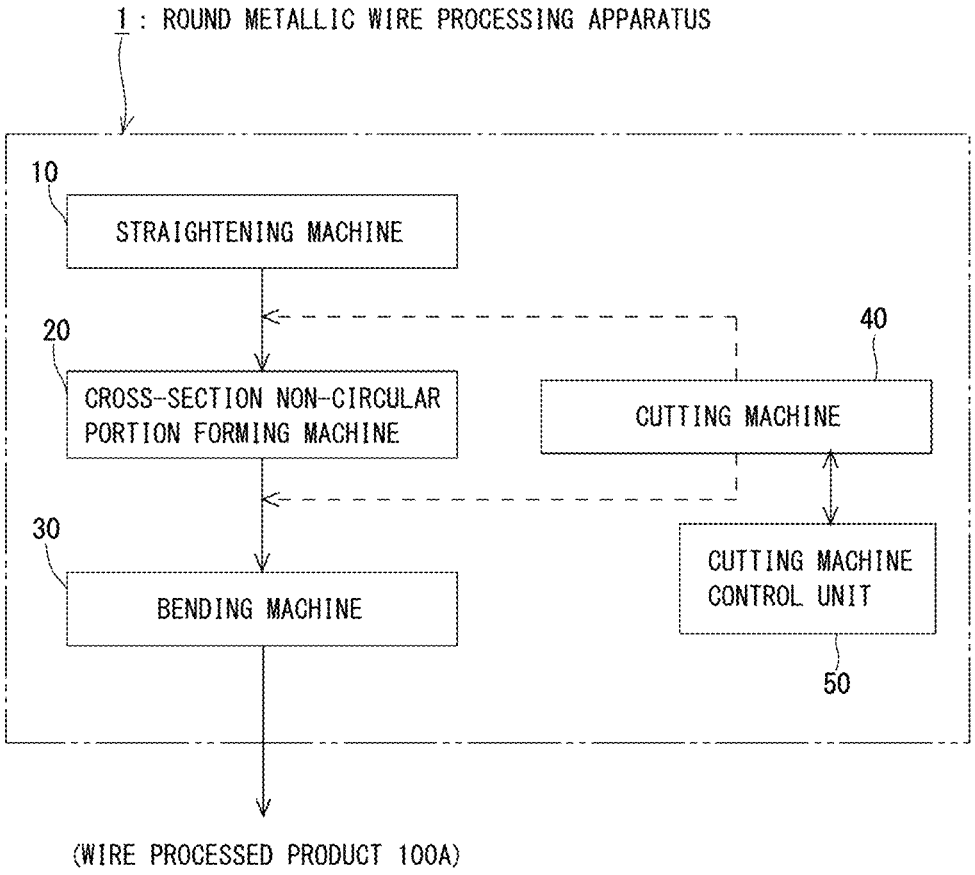
FIG. 3 is a diagram illustrating a schematic configuration of the round metallic wire processing apparatus according to one embodiment of the present invention.

Next, a processing method and a processing apparatus for the round metallic wire 100 used as described above will be described. FIG. 3 schematically illustrates a schematic configuration of the round metallic wire processing apparatus 1, and FIG. 4 and FIG. 5 each schematically illustrate each of processing machines for each processing step. As illustrated in these figures, the round metallic wire processing apparatus 1 of this embodiment includes a straightening machine 10, a cross-section non-circular portion forming machine 20, a bending machine 30, and a cutting machine 40.

Figure 4:
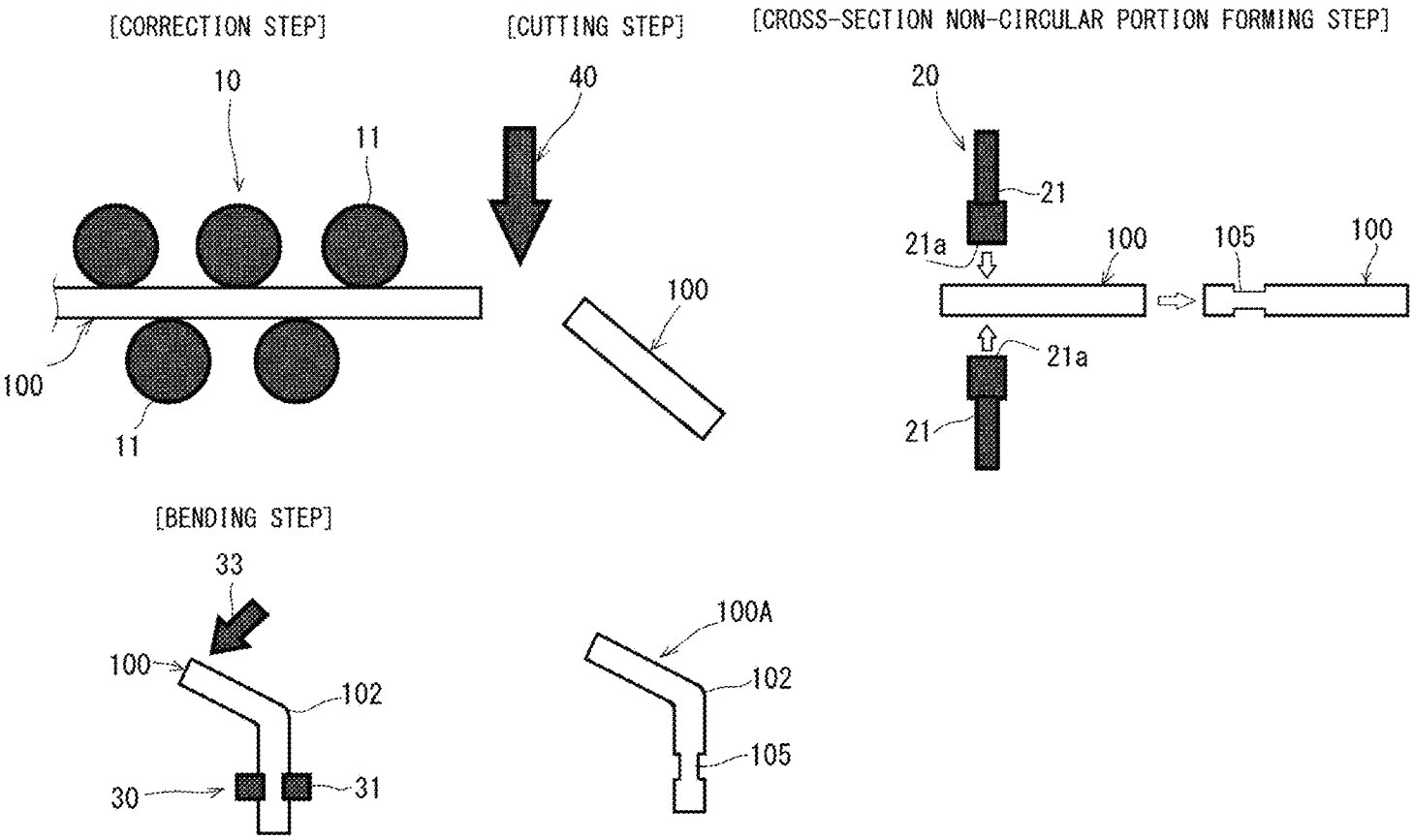
FIG. 4 illustrates a schematic configuration of each of processing machines for each processing step in a state of cutting the round metallic wire before forming a cross-section non-circular portion after correction.
Figure 5:
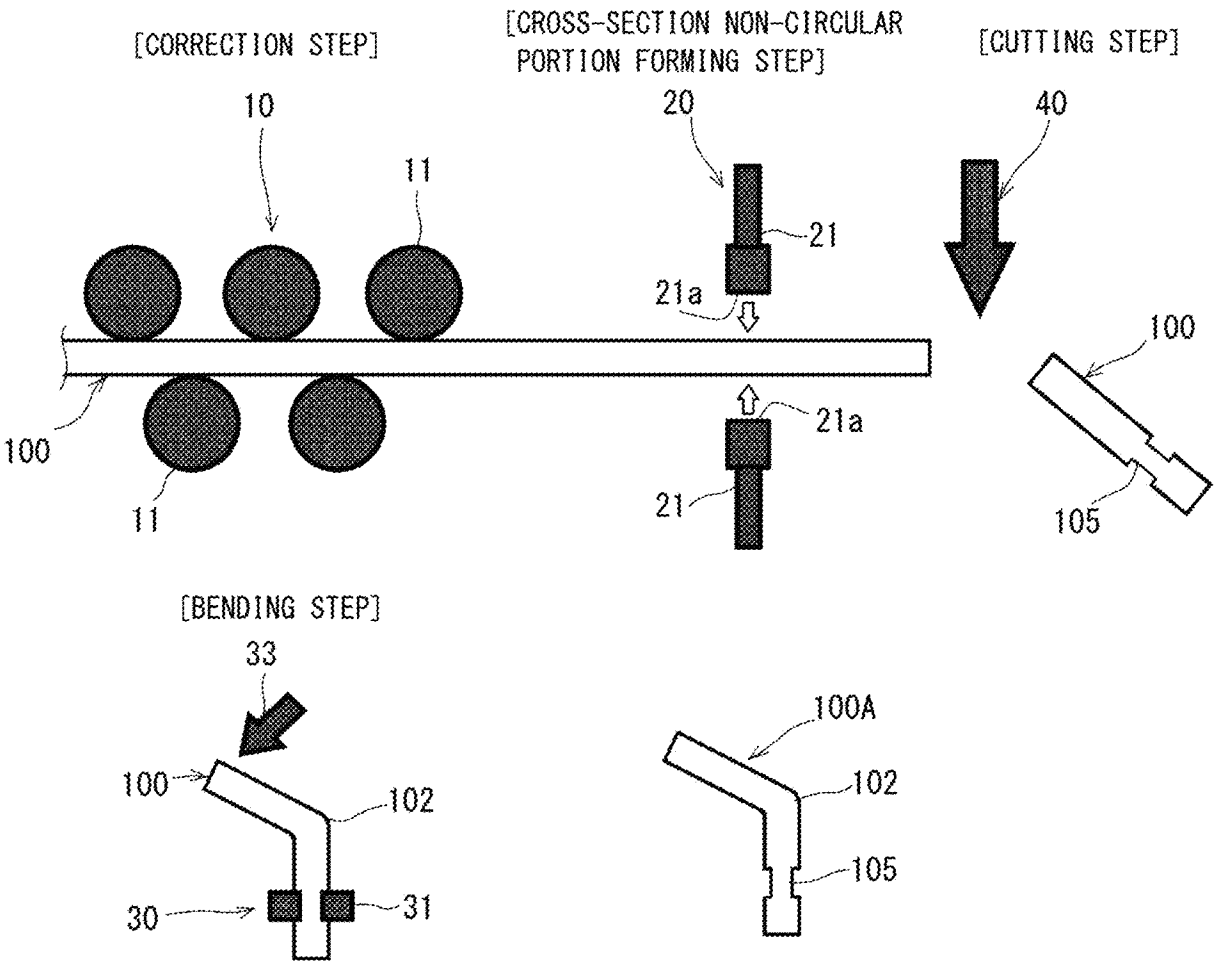
FIG. 5 illustrates a schematic configuration of each of the processing machines for each processing step in a state of cutting the round metallic wire before bending after the formation of the cross-section non-circular portion.

The straightening machine 10 includes, for example, a plurality of straightening rollers 11 disposed to be opposed, as illustrated in FIG. 4 and FIG. 5. The round metallic wire 100 targeted for processing is formed of a cross-section circular solid wire having a surface covered with enamel and made of metal such as copper, and provided as a coiled material wound in a coil shape. The straightening machine 10 is provided to correct its winding tendency caused by being wound in a coil shape. Here, in the wire processed product 100A illustrated in FIG. 1, end portions serve as the connecting portions 101, 101, and a film of enamel is removed from these connecting portions 101, 101. The enamel film is removed after the straightening by, for example, shaving the surface, using chemicals, or the like.

A cross-section non-circular portion forming machine 20 forms a predetermined portion of the round metallic wire 100 processed linearly by the straightening machine 10 in a non-circular shape in the cross-sectional shape in the diameter direction of the round metallic wire 100. A concrete structure of the cross-section non-circular portion forming machine 20 is not limited, but for example, is constituted of a pressing machine having pressing portions 21 which sandwiches the round metallic wire 100 on both sides along the diameter direction as illustrated in FIG. 4 and FIG. 5. A facing surface 21*a* facing the round metallic wire 100 on the pressing portion 21 has a shape roughly fitted to an abutting surface 31*a* of a wire holding portion 31 of the bending machine 30 which separates from and approaches the round metallic wire 100 (refer to FIG. 6(*a*), (*b*)). Concretely, for example, the wire holding portion 31 has at least the two abutting surfaces 31*a* on the round metallic wire 100, and at least one surface of them is formed of a flat surface, and hence at least one of the pressing surfaces 21*a* of the pressing portions 21 is also formed in a flat surface.

In this embodiment, both the facing surfaces 21*a*, 21*a* of the pressing portions 21, 21 on both 180-degree opposed sides of the cross-section non-circular portion forming machine 20 are formed as the flat surfaces. Accordingly, when these pressing portions 21, 21 approach each other, one pair of the opposing flat surfaces 105*a*, 105*c* serving as the cross-section non-circular portion 105 are formed, and next, by turning the round metallic wire 100 by 90 degrees centered at an axial center and making the pressing portions 21, 21 approach each other again, the other pair of the opposing flat surfaces 105*b*, 105*d* are formed, and the cross-section non-circular portion 105 having a substantially rectangular cross section in the diameter direction is formed.

However, the cross-sectional shape of the cross-section non-circular portion 105 is applicable unless circular, and for example, the flat surface may be formed only on one surface, or the flat surfaces may be formed only on two opposing surfaces. They may be formed on three or five surfaces or more. However, the closer the cross-sectional shape is to a circle, the more likely relative rotation between the cross-section non-circular portion 105 and the wire holding portion 31 of the bending machine 230 and the relative rotation, when the resin member 200 illustrated in FIG. 2 is molded integrally, between the two are to occur, and hence the flat surfaces are preferably set to eight surfaces or less. In addition to this, a modified cross section partially having any depression or projection such as a cross-section square or triangle is also applicable. In any case, these surfaces may each be in a shape having at least one flat surface capable of surface contact with the abutting surface 31*a* of the wire holding portion 31 of the bending machine 30. Having at least one flat surface causes the abutting surface 31*a* of the wire holding portion 31 of the bending machine 30 to come into surface contact therewith, and thereby the round metallic wire 100 can be prevented from rotating centered at the axial center at the time of bending.

Figure 6B:
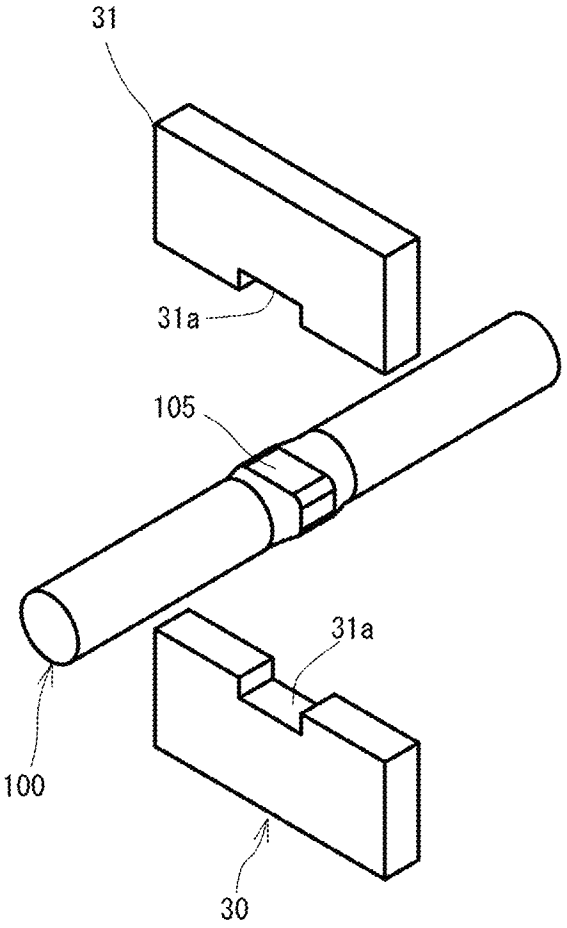
FIG. 6(*a*) illustrates one example of a wire holding portion of a bending machine, FIG. 6(*b*) illustrates the other example of a wire holding portion of the bending machine.
Figure 6A:
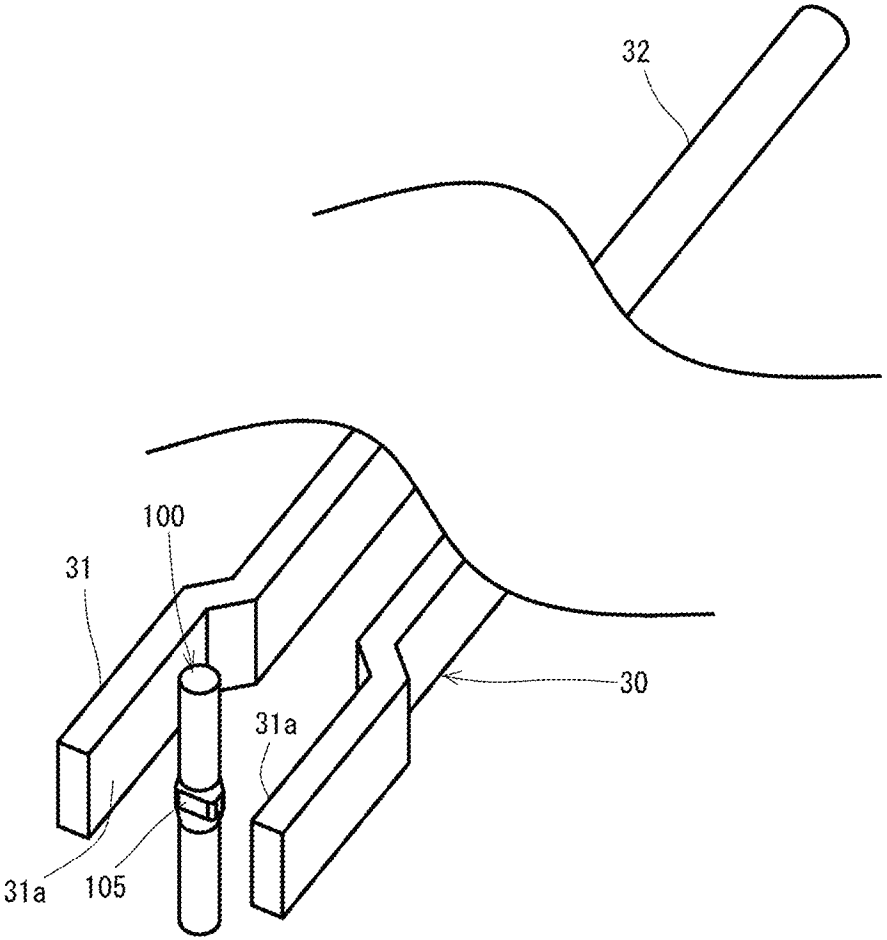

As the bending machine 30, for example, the one provided with the wire holding portion (chuck) 31 at a tip of a three-dimensionally movable robot arm 32 as illustrated in FIG. 6(*a*), the one having the wire holding portion 31 provided with a pair of opposing plates capable of separating from and approaching each other (corresponding to a portion in which work in a press die is held) as illustrated in FIG. 6(*b*), or the like can be used. In each of these wire holding portions 31, at least one surface (the two opposing surfaces in this embodiment) on which the round metallic wire 100 is held is set as the flat surface. Accordingly, as long as the round metallic wire 100 on which the flat surfaces 105*a* to 105*d* are formed by the cross-section non-circular portion forming machine 20 is set in each of these wire holding portions 31, the round metallic wire 100 does not rotate centered at the axial center despite having a cross-section circular shape in portions expect the cross-section non-circular portion 105.

In FIG. 6(*a*), the bending machine 30 has the wire holding portion (chuck) 31 and a working portion (not illustrated) which comes into contact with the round metallic wire 100, and either or both of these move three-dimensionally, and thereby the round metallic wire 100 is bent at a predetermined angle in a predetermined direction, or the like, and the round metallic wire 100 is processed in a predetermined three-dimensional shape to design specifications. In FIG. 6(*b*), for example, the round metallic wire 100 is held between a pair of the abutting surfaces 31*a*, 31*a* of the wire holding portion 31 formed of the two plates, and a portion protruding from the wire holding portion 31 is approached from any direction by and brought into contact with a processing tool 33 (refer to "bending step" in FIG. 4 and FIG. 5) to be thereby processed in a predetermined shape. Then, by varying the directions of the round metallic wire 100 or using the one capable of approaching it from different directions as the processing tool, the three-dimensional shape is imparted. Note that a concrete structure of the bending machine 30 is not limited at all as long as the round metallic wire 100 can be subjected to bending.

The cutting machine 40 cuts the round metallic wire 100 in a predetermined length in accordance with the design specifications. As long as the round metallic wire 100 can be cut, its structure is not limited at all. In this embodiment, a cutting machine control unit 50 which automatically operates the cutting machine 40 is included (refer to FIG. 3). The cutting machine control unit 50 controls the cutting machine 40 so as to perform cutting operation in the predetermined length in accordance with the beforehand set design specifications. The cutting machine control unit 50 only needs to control a cutting length, and in this embodiment, moreover, timing of operating the cutting machine 40 can also be automatically controlled. Specifically, the round metallic wire 100 is straightened by the above-described straightening machine 10, and thereafter at either timing before being transferred to the cross-section non-circular portion forming machine 20 (the state in FIG. 4) or timing before being transferred to the bending machine 30 after the formation of the cross-section non-circular portion 105 (the state in FIG. 5), the cutting machine 40 is operated to cut the round metallic wire 100 in the predetermined length.

The timing of cutting by using the cutting machine 40 can be optionally set depending on the kind of the three-dimensional shape to be imparted to the round metallic wire 100, the required dimensional accuracy, and the like. As illustrated in FIG. 4, cutting after the straightening makes, even when the cross-section non-circular portion 105 is formed in any position of end portions and a middle portion, its positioning easy, and also makes handling of the bending thereafter easy. Further, cutting after the bending sometimes also causes deformation due to a shock at the time of cutting, but the prior cutting eliminates such a possibility as described above.

As illustrated in FIG. 5, cutting before the bending after the formation of the cross-section non-circular portion 105 makes it easy to perform the bending, but makes the positioning of the formation position of the cross-section non-circular portion 105 more difficult than that in cutting prior thereto since the cross-section non-circular portion 105 is formed while keeping the round metallic wire 100 long. On one hand, by forming the cross-section non-circular portion 105, a size in a long direction is sometimes somewhat affected by a deformation in the diameter direction. Further, the cutting after the bending sometimes causes the deformation as described above. Thus, when the dimensional accuracy is required more strictly, or the like, the round metallic wire 100 is also considered to be kept long until the formation of the cross-section non-circular portion 105 and cut before the bending.

Next, one example of a method for processing the round metallic wire 100 will be described based on FIG. 4 and FIG. 7. In the processing method of this embodiment, as described above, the material provided in a coil shape is transferred to the straightening machine 10 of the round metallic wire processing apparatus 1 to be linearly corrected (S1 in FIG. 7). Thereafter, in accordance with specifications of the wire processed product 100A, an enamel cover is peeled for each predetermined distance so that the connecting ends 101, 101 to the terminals or the like at attachment positions are formed.

Figure 7:
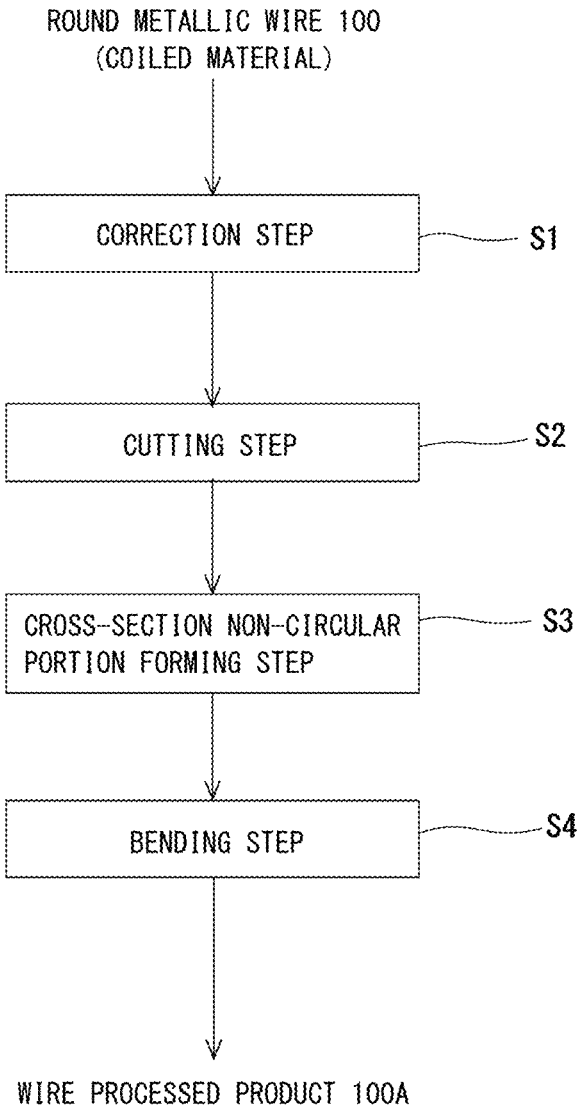
FIG. 7 is a flowchart illustrating one example of the processing steps of the round metallic wire in the state in FIG. 4.

Next, for example, the linearly corrected round metallic wire 100 is cut in a predetermined length by the cutting machine 40 (S2 in FIG. 7). The advantage such that cutting at this time makes handling of later processing easy is as described above. Subsequently, the round metallic wire 100 cut in the predetermined length is transferred to the cross-section non-circular portion forming machine 20 to form the cross-section non-circular portion 105 (S3 in FIG. 7). The cross-section non-circular portion 105 is formed in at least one position. The cross-section non-circular portion 105 is provided to prevent movement in a rotation direction when held by the wire holding portion 31 in the bending machine 30, and in varying the portion held by the wire holding portion 31, using a plurality of the bending machines 30, or the like, corresponding thereto, the cross-section non-circular portions 105 can be formed in a plurality of positions.

Next, the cross-section non-circular portion 105 is held by the wire holding portion 31 of the bending machine 30, and a three-dimensional shape in accordance with the design specifications is imparted (S4 in FIG. 7). At this time, when the plurality of bending machines 30 are used, it is possible to in the initial bending machine 30, hold the cross-section non-circular portion 105 in a certain predetermined position in the wire holding portion 31 and perform the bending, and thereafter in the next bending machine 30, hold the cross-section non-circular portion 105 formed in a different position therefrom in the wire holding portion 31 and perform the bending, for example.

Figure 8:
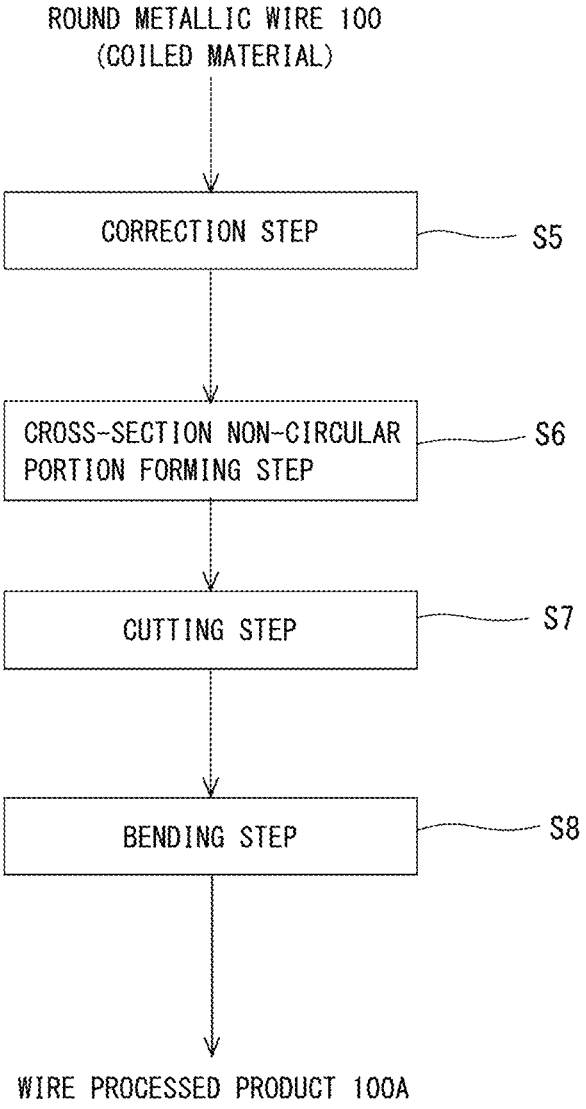
FIG. 8 is a flowchart illustrating one example of the processing steps of the round metallic wire in the state in FIG. 5.

This completes the wire processed product 100A. Note that the timing of the cutting step is thus not limited to before the formation of the cross-section non-circular portion after the correction, but as illustrated in FIG. 5, is also applicable to after the formation of the cross-section non-circular portion as described above. FIG. 8 is a flowchart illustrating one example of processing steps in that case, and after the correction step (S5 in FIG. 8), the cross-section non-circular portion is formed (S6 in FIG. 8), cutting is thereafter performed (S7 in FIG. 8), and the bending step is performed (S8 in FIG. 8) to obtain the wire processed product 100A.

According to this embodiment, with respect to the round metallic wire 100, the cross-section non-circular portion 105 is formed before the bending. Therefore, by holding the cross-section non-circular portion 105 in the wire holding portion 31, the bending can be performed, which allows the prevention of the movement in the rotation direction centered at the axial center at the time of bending, or the like, resulting in enabling an increase of bending accuracy. Further, making a holding position of the wire holding portion 31 stable reduces variations in processing accuracy among products. Further, the round metallic wire 100 is transferred between the machines by feed rollers (not illustrated), and after the formation of the cross-section non-circular portion 105, a slide with respect to the feed rollers is suppressed, which also enables suppression of a deterioration of the processing accuracy caused by variations in feed rate.

Further, when dimensions of the processed wire processed product 100A are measured using an optical microscope, a visible outline of the cross-section non-circular portion 105, in particular, a surface processed in the flat surface is easy to observe. That is, in a circular cross section, it is difficult to focus on a tangent of the circular cross section when it is observed by the optical microscope, which sometimes affects dimensional measurement accuracy, but according to this embodiment, it becomes easy to focus on the visible outline of the flat surface or the like, which increases the dimensional measurement accuracy.

Figure 9:
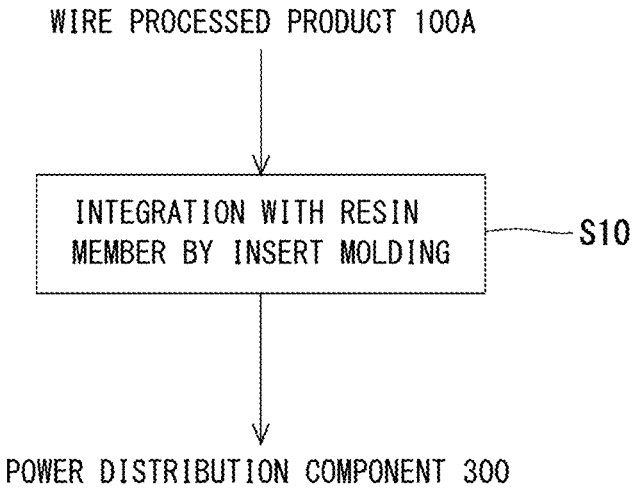
FIG. 9 is a flowchart illustrating one example of a step of a method for manufacturing a power distribution component according to one embodiment of the present invention.

Next, when to use the wire processed product 100A of this embodiment as, for example, a power distribution component, it is integrated with the resin member 200 which functions as a rotation stopper for an attachment portion, or the like, the resin member 200 is integrated with the cross-section non-circular portion 105 by the insert molding (S10) to obtain a power distribution component 300 (refer to FIG. 2), as illustrated in FIG. 9. The obtained power distribution component 300 does not rotate mutually since the resin member 200 is integrated with the cross-section non-circular portion 105. According to the present invention, the cross-section non-circular portion is not required to be formed by additional processing after completing the wire processed product as conventionally formed, and it is possible to prevent an influence on dimensional accuracy and a deformation accompanying the additional processing.

According to the above, the wire processed product 100A and the power distribution component 300 of the round metallic wire 100 obtained by the present invention are particularly suitable for uses requiring high dimensional accuracy, accuracy of form, and the like despite an inexpensive round wire as compared with a square wire.

The invention claimed is:

1. A method for manufacturing a power distribution component for use in a predetermined position of an electric device, the method including the steps of: processing a round metallic wire formed of a cross section circular solid wire for use as a conductor of the power distribution component, wherein:

a correction step of linearly correcting a coiled material of the round metallic wire;

a cross-section non-circular portion forming step of forming a cross-section non-circular portion having a non-circular cross-sectional shape in a diameter direction in at least one position of the round metallic wire linearly corrected by the correction step; and a bending step of holding the cross-section non-circular portion in a wire holding portion of a bending machine and performing bending in a predetermined three-dimensional shape, and the method further comprising the step of:

integrally attaching a resin member on an outer periphery of the cross-section non-circular portion of the processed product of the round metallic wire, wherein in the cross-section non-circular portion forming step, the cross-section non-circular portion is processed in a shape including a flat surface which comes into surface contact with an abutting surface of the wire holding portion of the bending machine.

2. The method for manufacturing a power distribution component according to claim 1, wherein at either timing after the correction step and before the cross-section non-circular portion forming step or timing after the cross-section non-circular portion forming step, the round metallic wire is cut in a predetermined length.

3. A round metallic wire processing apparatus for subjecting a cross-section circular solid wire, for use as a conductor in a predetermined position of an electric device, to bending in a predetermined three-dimensional shape, the apparatus comprising:

a straightening machine configured to linearly correct a coiled material of a round metallic wire formed of the cross-section circular solid wire, wherein the apparatus further comprises a cross-section non-circular portion forming machine configured to form a cross-section non-circular portion, the portion where a resin member being integrally attached on an outer periphery thereof after the processing a round metallic wire, having a non-circular cross-sectional shape in a diameter direction in at least one position of the round metallic wire linearly corrected by the straightening machine;

a bending machine configured to hold the cross-section non-circular portion in a wire holding portion and configured to perform bending in the three-dimensional shape; and a cutting machine configured to cut the round metallic wire, wherein the cross-section non-circular portion forming machine comprises having pressing portions which sandwiches the round metallic wire on both sides along the diameter direction, wherein a facing surface facing the round metallic wire on the pressing portion has a shape fitted to an abutting surface of the wire holding portion of the bending machine.

4. The round metallic wire processing apparatus according to claim 3, further comprising a cutting machine control unit which at either timing after the correction and before the formation of the cross-section non-circular portion or timing after the formation of the cross-section non-circular portion and before the bending, controls the cutting machine to cut the round metallic wire in a predetermined length.

* * * * *